United States Patent [19]

Ballhause

[11] Patent Number: 4,722,696

[45] Date of Patent: Feb. 2, 1988

[54] ENVIRONMENTALLY AND ABUSE-PROTECTED PLUG CONNECTOR

[75] Inventor: Lutz Ballhause, Waiblingen, Fed. Rep. of Germany

[73] Assignee: Robert Bosch GmbH, Fed. Rep. of Germany

[21] Appl. No.: 941,407

[22] Filed: Dec. 15, 1986

[30] Foreign Application Priority Data

Dec. 20, 1985 [DE] Fed. Rep. of Germany ..... 3545223

[51] Int. Cl.[4] ..... H01R 13/52

[52] U.S. Cl. ..... 439/275

[58] Field of Search ..... 339/94 R, 94 A, 94 M, 339/94 L, 103 R, 103 M, 103 B, 255 R, 259 R; 439/275

[56] References Cited

U.S. PATENT DOCUMENTS

| | | | |
|---|---|---|---|
| 2,277,637 | 3/1942 | Eby | 339/103 B X |
| 2,427,742 | 9/1947 | Peterson et al. | 339/103 B |
| 2,750,436 | 6/1956 | Richter | 339/94 A X |
| 3,056,852 | 10/1962 | Sachs | 339/103 B X |
| 3,172,721 | 3/1965 | Kelly | 339/94 A X |
| 3,406,370 | 10/1968 | Gaw | 339/103 B X |
| 4,225,206 | 9/1980 | Roman, Jr. . | |
| 4,310,213 | 1/1982 | Fetterolf, Sr. et al. | 339/103 M |
| 4,629,273 | 12/1986 | Van Camp | 339/94 M |

FOREIGN PATENT DOCUMENTS 0033031 5/1981 European Pat. Off. .

*Primary Examiner*—Z. R. Bilinsky

*Attorney, Agent, or Firm*—Frishauf, Holtz, Goodman & Woodward

[57] ABSTRACT

To provide for reliably sealing conductors or cables into a plug connector housing, the plug connector housing is formed with bores (2) in each of which a sealing bushing or sleeve (5) is located surrounding the outer insulating jacket (3a) of the conductor or cable. To protect the seals and prevent distortion and damage to the seals upon bending of the cables, and end seating and retaining part is received in an end recess (9) of the housing . The end seating and retaining part, in accordance with the invention, is formed of two half elements (11, 12) which surround the cables (3) and extend through the recess (9) from the bores (2) towards the end of the housing. The two elements (11, 12), each, are retained in the housing by a projection-and-recess snap-in connection (21, 23; 22, 24), and the two elements permit easy assembly which can be automated for mass production. For two or more conductor plugs the recess is "figure 8" or undulated shaped, and the two half-elements are "half-figure 8" or undulated elements, each with semi-cylindrical recesses (17, 18) surrounding an associated conductor or cable, which extends inwardly into an individual bore (2) in the housing.

21 Claims, 3 Drawing Figures

ENVIRONMENTALLY AND ABUSE-PROTECTED PLUG CONNECTOR

The present invention relates to a plug connector, and more particularly to a plug connector for a cable connection, which may be a single or multiple cable, in which the cable is carried through the plug connector in sealed relation to provide an environmentally protected seal against moisture and the like, and which further is so constructed that damage to the seal due to mishandling of the connector is effectively prevented, while being simple to assemble.

BACKGROUND

Various types of plug connectors are known, for example plug connectors in which a cap member is snapped on a housing of the plug connector, see European Pat. No. 0 033 031, Bunnel et al. This reference discloses a cap element, usually a single unitary structure, which must be fitted on the cable passing through the plug connector. If the cable has a multiple number of strands, each one, for example, embedded in a part-circular or part-oval insulation, with the respective strands connected by webs integral with the insulation, it is difficult to fit a cap on such cables and, then, to fit the element into a housing. Insufficient space is available to fit the strands of the cable with their caps. Constructing a wiring harness with a multiplicity of insulated wires or cables of this kind is expensive. If, additionally, a moisture and contamination resistant seal is provided retaining this seal securely in position in sealed relation is difficult if, for example, the cables or wires emanating from the housing are bent sharply as soon as they leave the seal. This bending stress propagates itself to the interior of the housing where the seal is located, thereby interfering with the integrity of the seal.

U.S. Pat. No. 4,225,206 discloses an electrical connector for electromagnetic fuel injectors. An electrical socket connector is detachably secured to an electromagnetic fuel injector having a pair of upstanding pin terminals located on opposite sides of and radially spaced from an upstanding central boss. The electrical socket connector has a connector body comprising a pair of longitudinal, laterally spaced terminal housings, each having a pin grip terminal disposed therein and receiving one of the pin terminals. The terminal housings are connected together by intergral bridges and a pair of longitudinally spaced, vertical latch arms are disposed between the terminal housings and pivotally connected thereto for latching onto the central boss. A seal member comprises a pair of electrometric sleeves which are connected by an integral saddle at one end and mounted on the depending sockets respectively. Each sleeve has an inward circular sealing lip which seals around a plastic sleeve surrounding the pin terminal inserted into its associated socket.

As can be seen, the connector has two conductor wires 32 with individual seals. The latch arms are formed as lock flaps which are formed with slots which are open towards the bottom, so that the connecting lines can be sharply bent off, thus interfering with the seal. The locking flaps are engaged with the housing at the outside thereof.

THE INVENTION

It is an object to provide a plug connector in which the sealing integrity of an internal seal will be maintained, and which is so constructed that it is simple to assemble, for example by automatic or at least semi-automatic production machinery, and which insures that pull-out of the cables, impairment of the integrity of the seal and the like is prevented, while protecting the emanating cables or electrical insulated conductors against bending, creasing or kinking.

Briefly, the housing is formed with a cable or conductor receiving bore in which a conductor or cable end portion, including an insulation sheath, is placed. A seal seals the outside of the conductor insulation against the inside of the bore of the housing, the seal being located within the bore, leaving some distance towards the outer end thereof. The housing can be formed with multiple, parallel bores to receive a plurality of conductors, for example positioned adjacent each other. The conductors need not extend parallel to each other once outside of the housing.

In accordance with a feature of the invention, the housing is formed with an end recess, in which a retaining part is fitted it is placed over the insulation sheath of the conductor. The retaining part is formed of two preferably identical elements of essentially half-cylindrical shape. If a plurality of conductors are to be received in a single housing, the end portions of the individual conductor receiving bores can merge into a single enlarged recess, in which half-elements formed with connecting webs can be inserted. The half elements each, roughly, will have the shape of a figure 8, slit lengthwise in half. The half-elements have matching flat sides engaging each other; for multiple-conductor connection the webs, likewise, will be formed with flat surfaces.

The half-cylindrical elements can readily be assembled outside of the housing with matching flat sides placed against each other. While being held in this position, they are slid over the conductors, inserted into the bore of the housing, and pushed against the seal. It is easier, however, to pre-assemble the conductors in the respective bores, and then press the half-elements together, or sequentially in the terminal recess portion. The half-elements are thus compressed against each other by engagement with the wall of the housing while surrounding the conductors. The half-elements are retained within the housing by a snap-in connection, for example a projecting finger snapping into a recess or an opening formed in the housing.

The arrangement has the advantage that the retaining part, formed as a two-element part, can be easily assembled over the cable after connection terminals and the like as well as the seal are secured and sealed in the bores and after the subassemblies are positioned in the housing. At the same time, the seating retaining parts securely and reliably protect the seal, prevent kinking, bending or otherwise interfering with the portion of the cable adjacent the seal so that the integrity of the seal will not be impaired; and further provide engagement surfaces for the conductor to prevent pull-out of the conductor and/or electrical parts thereof. The arrangement is suitable for use with a single conductor, but is particularly suitable for use with two or more conductors. For three or more conductors, the half-elements are suitably formed by extending the essentially half-cylindrical portions to surround each one of the conductors. Of course, single half-cylindrical elements may also be used with multiple conductors placed next to each other in a common housing.

In accordance with a feature of the invention, the connector is a flat-type connector in which two or more connecting lines are located in a plane, parallel to the separating plane of the two elements of the retaining part—which also forms a cable seating part—the elements being shaped to receive the external portion of the cable, being themselves seated in a suitable recess formed in the plug housing, and being, each, individually snap-retained within the housing.

The arrangement has the advantage of simplicity in assembly, permitting automated or semi-automated assembly, while reliably holding the retaining part in the housing. By placing the interengaging snap-in connection inwardly of the housing, inadvertent loosening is effectively prevented, while, additionally, maintaining the mechanical strength of the housing. A reliable engagement connection is particularly important when the plug connector is to be used in an automotive environment, where it is subject to shock, vibration, and possible mishandling. The arrangement, thus, permits particularly economical and simple assembly of a plurality of cables or conductors into a multi-terminal plug connector, reliably sealing the individual conductors in the plug connectors, and maintaining the seal, in spite of possible mishandling of the cables or conductors immediately adjacent the plug connector.

DRAWINGS

DETAILED DESCRIPTION

The plug unit has a housing 1 formed, for example, as an injection-molded structure of insulated plastic. The plug unit is suitable for use with one conductor or cable 3, but is especially suitable for use with a plurality of conductors for example for two to four conductors. The preferred embodiment, shown with two conductors, will be described in connection with the Figures of the drawings.

Figure 2:
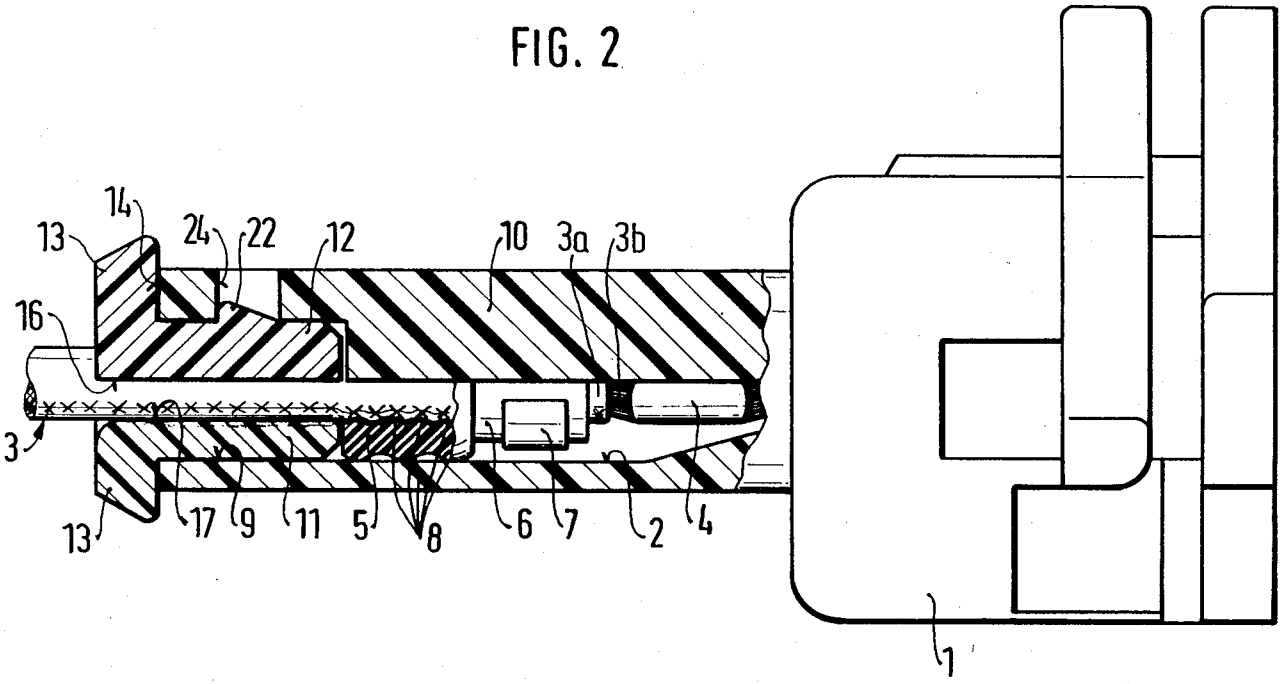
FIG. 2 is a longitudinal part-sectional view taken through the section line II—II of FIG. 1, which, it is to be noted, is a broken section line.

The housing 1 is formed with two longitudinal openings or bores 2 (FIG. 2). An end of a respectively associated electrical conductor 3 is located in the bore 2. Each one of the conductor 3 has an outer insulating jacket **3*a* and an inner conductor core 3*b*. The respective conductor core 3*b* which, typically, is stranded, is connected to a respective electrical coupling terminal 4. The coupling terminal 4 is formed, as well known, as a prong, blade, or sleeve or banana-plug connector, which can be formed, as well known, with an engagement hook to seat the connector securely in the housing 1, for example by engaging behind a shoulder—not shown—in the longitudinal bore 2. A respective sealing bushing 5 is located on each one of the conductors 3. The sealing element 5 is in form of a sleeve. Thus, each conductor 3 has an individual and hence particularly effective single seal. The seal 5 has an extension 6 which is clamped by a crimp flap of the respective electrical coupling terminal 4 on the insulating jacket of the respective conductor 3**.

For assembly, first, sealing bushing 5 is slipped over conductor 3. The connector 4 and the crimp connection 7 are placed on the respective conductor 3, crimped, and the subassembly is pushed in the associated bore of the housing 1 until the coupling connector element 4 is received into a recess provided therefor—not shown in the drawings since well known and standard—to securely retain the connector in the housing. The sealing bushing or sleeve 5, shown partly in section, is formed at its inner and outer surfaces with corrugations 8, forming ridges and grooves. The sealing bushing 5 is elastic, and securely engages the inner wall of the longitudinal bore 2, as well as the outer surface of the jacket **3*a* of the conductor 3**.

The longitudinal bores 2 extend towards the outside and terminates in a generally—in cross section—oval-shaped recess 9. The recess 9 is located in a tubular terminating section 10 of the housing 1. For purposes of illustration, a two-terminal plug connector is shown. In such a connector, the recess 9, forming an end portion, has essentially in cross section an undulating configuration which can be termed a horizontal "figure 8".

In a single-pole, single-conductor connector, a cylindrical cross section is suitable; in a three or more, or multiple-conductor connector, having more than two terminals, the essentially horizontal "figure 8" shape of the recess 9 is is extended by additional circular portions, for example half-figure 8 formations, continuous figure 8 formations or the like, in dependence on whether three or more terminals are to be connected to define, in general, an undulating configuration. The horizontal central plane of the recess 9, in a two-pole connector, extends, as shown, through the longitudinal axis of the two adjacent electrical conductors or cables 3, placed in parallel, spaced in the opening 9. All the bores 2 in the housing receiving the respective conductors terminate in the recess 9. The seals 5, surrounding the individual cables or conductors 3 located inside the bores 2, terminate at recess 9.

Figure 1:
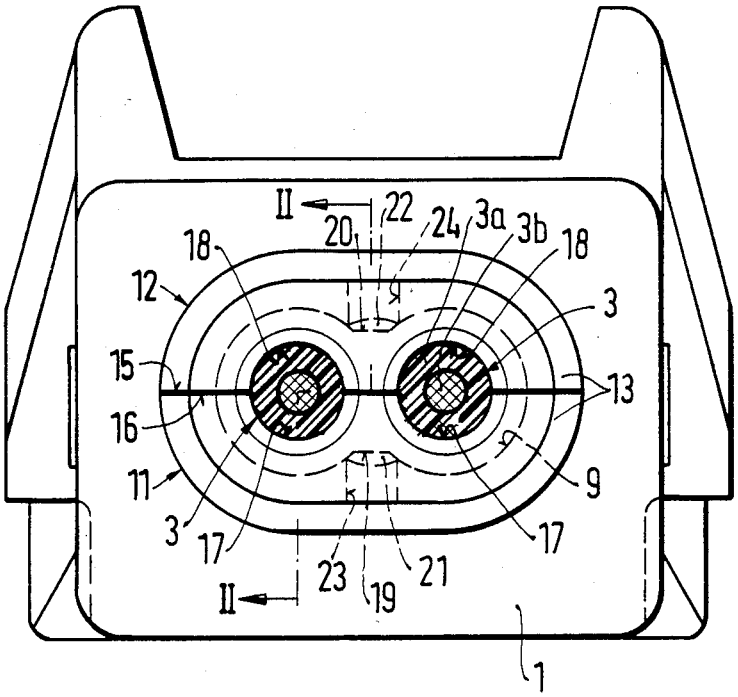
FIG. 1 is an end view of the plug connector, looked at from the end from which the cables emanate, the cables being cut to illustrate their position in the plug connector.
Figure 3:
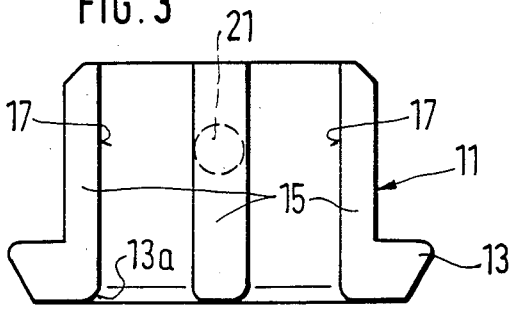
FIG. 3 is a top view of a bottom seating and retaining part alone, removed from the plug connector.

It is known to terminate a connector by fitting an end retaining part against the seal 5. In accordance with the present invention, and end seating and retaining part is provided, formed by a two-element structure. The seating and retaining part, thus, has two halves. FIG. 3 is a top view of the bottom half 11; the top half 12 can be identical. Each half, in end view, has a generally figure 8 shape, which is split along an axis passing through the major extent of the figure 8. The two identical halves 11, 12 form a shaft-like portion filling the recess 9. The halves, each, are formed with a flange-like end portion 13, extending from the recess 9 and, as shown in FIG. 2, engaging the facing end surface 14 of the tubular end portion 10 of the housing 1. The two halves 11, 12, forming the "split figure 8", have engagement surfaces 15, 16 which match and fit against each other. As best seen in FIG. 1, the engagement surfaces 15, 16 extend horizontally through the horizontal central plane of the recess 9. The engagement surfaces 15, 16 are formed with semi-cylindrical recesses 17, 18 fitting about and around the circular outer circumference of the conductor 3. The number of recesses 17, 18 depends on the number of the conductors 3 passing into the housing 1 and to be connected by the plug connector. The half elements 11, 12, together, hold the sealing bushings 8 in sealing position in the respective bores 2. The element 12, 13 are of insulating material.

The surfaces 15, 16 are parallel to each other, and extend over the entire length of the halves 11, 12. They can be slightly rounded or chamfered at the extreme terminal end adjacent the flange 13, as seen at 13*a*, FIG. 3, to provide a smooth transition for the outer jackets 3*a* of the conductor 3 if they should be sharply bent. The radius of the chamfer 13*a* can be matched to the design bending radius of the respective conductor 3.

The outer jacket of the conductor or cable 3 is circular at the external surface thereof. The recesses 17, 18 in the halves match the shape of the external surface of the jacket. If three or more cables are used, the opening 9 is extended by the size of a respective number of half "figure 8" portions, corresponding to the number of cables or connections of the plug connector, so that all bores 2 can terminate in recess 9. The outer circumferences of the shaft-like portions of the element halves 11, 12 are matched to the shape of the openings 9. The rounded portions of the half 11 are bridged by a connecting web forming a depressed or constricted portion 19; the rounded portions of the half 12 are bridged by a depressed or constricted web portion 20. Snap-in engagement projections 21, 22 are molded on the respective halves 11, 12 at the location of the depressed or constricted portions 19, 20, respectively.

The tubular end portion 10 of the housing 1 is formed with opposite cross openings 23, 24: alternatively, internal depressions which provide abutment surfaces may be provided. The projections 21, 22 on the halves 11, 12 can snap behind the shoulders defined by the respective openings 23, 24 upon pushing-in of the two halves. Use of openings permits unsnapping and severing of the halves from the recess 9. The end facing surface 14 of the tubular end portion 10 of the housing 1 forms an abutment surface for the halves 11, 12. The snap-in projection-and-recess arrangement 21, 22; 23, 24 forms a simple and releasable attachment for the halves of the end seating and retaining part in the housing 1, 9, 10. In a single-pole plug connector, it is desirable to form the projections 21, 22 at the outermost distance from the separating surfaces 15, 16, that is, at opposite locations with respect to the separating surfaces 15, 16. In connectors with more than two cables, and having a plurality of restrictions on the respective element halves of the seating and retaining part, a plurality of projections can be used, for example one at each such depression, in order to provide for reliable engagement of the respective element halves of the seating and retaining part in the housing. For a three-terminal connector, two interengaging projection-and-recess means similar to the projections 21, 22 and the openings 23, 24 may be sufficient, although one at each depression is preferred for reliability and security in seating. Assembly of the electrical two-pole connector structure shown in FIGS. 1 to 3 of the drawing. After the subassemblies formed by the cables 3, each cable being provided with one terminal 4, 7 and one seal 5, 6, 8, have been seated in their associated bores 2 and secured therein, the cables 3 are surrounded by the half elements 11, 12 of the end seating and retaining part, and the half elements are pushed, preferably together, into the recess 9 of the housing until the inner surface of the flange 13 engages the facing end surface 14 of the end portion 10 of the housing, which also will cause the projections 21, 22 of the half elements to snap behind the abutment shoulders formed by the respective openings 23, 24 of the housing 1, 9, 10. The elements 11, 12 of the end seating and retaining part protect the seals 5 of the respective cables 3 and retain the seals in position in the respective bores 2. Further, they prevent removal or loosening of the seals 5, for example, jiggling or bending of the cables 3 or any of the cables 3. The cables 3 together with the electrical terminals 4 are likewise secured against pull-out from the housing 1; removal of the cables 3 or pull-out upon mishandling, for example to sever the plug connection by pulling a cable 3 rather than gripping the housing 1, 10, will not cause the cable to be severed from the housing; likewise, the two elements 11, 12 of the end seating and retaining part prevent the cables 3 and the electrical terminals 4 from being pushed axially towards the left—with respect to FIG. 2—for example by a counter plug, or upon engagement with a socket (not shown), for example if connecting or engagement hooks on the terminals 4 did not stand the engagement pressure or were poorly located in the housing; or if the plug-socket connection was made incorrectly. The guidance of the cables 3 in the associated pairs of recesses 17, 18 of the respective halves 11, 12 additionally prevents sharp bending of the cables 3 in the region where they leave the seals 5, so that the integrity of the seals will not be impaired regardless of the position in which the cables 3 will be placed after leaving the housing 1, 10 of the electrical connector structure. The seals 5 cannot distort or cant, which otherwise might result in loss of sealing.

I claim

1. Environmentally and mechanically protected cable lead-in and plug connector structure having a housing (1, 10) of insulating material formed with a cable receiving bore (2) and terminating in an end recess (9) larger than said bore;

a cable end portion (3) including an insulating sheath (3*a*) and a conductive core (3*b*) located in the bore;

an electrical terminal (4,7) secured to the core (3*b*) and attached to the insulating sheath (3*a*);

a cable seal (5, 8) sealing the outside of the cable insulating sheath against the inside of the bore (2) of the housing, and located in said cable receiving bore inwardly of the end recess (9) and between said recess and said terminal;

and an end seating and retaining part of insulating material fitted into the end recess (9) of the housing and closing the cable receiving bore (2) and said end recess of the housing towards the outside, while locating and retaining said seal (5, 8) in said bore;

wherein, the end seating and retaining part comprises two elements (11, 12) of essentially half-cylindrical shape, having matching engagement surfaces (15, 16) and formed with recesses (17, 18) surrounding the outside of the insulating sheath (3*a*) of the cable (3);

and wherein said elements (11, 12) and an end portion (10) of the housing (1) within which said recess is located are formed with releasable interengaging projection-and-recess means (21, 23; 22, 24) for retaining said two elements (11, 12) of the seating and retaining part in position in the housing and to close off said bore (2) to protect the seal (5, 8) therein, and for positively positioning the portion of the cable between the end of the housing and said seal within the bore, and thereby protect the seal against loosening and damage transferred thereto by mishandling of the cable.

2. The structure of claim 1, wherein the projection-and-recess means comprises a recess formed in the housing defining an abutment shoulder, and a snap-in projection formed on each of the elements (11, 12) positioned and dimensioned to snap behind said abutment shoulder.

3. The structure of claim 1, wherein the matching engagement surfaces (15, 16) of said two seating and retaining part elements (11, 12) define a separating plane, said separating plane passing approximately centrally through said cable.

4. The structure of claim 3, wherein said seating and retaining part elements comprise parallel half-cylinder portions;

and wherein said interengaging projection-and-recess means comprise projection elements located on the outside of each of said elements, and engageable behind a recess formed in the housing opposite each said projection in a plane essentially perpendicular to a longitudinal axis of the housing.

5. The structure of claim 1, wherein each one of said seating and retaining part elements (11, 12) is formed with the projections (21, 22) of interengaging projection-and-recess means, said projection and recess means extending in a plane at least approximately perpendicular to the longitudinal axis of the housing (1).

6. The structure of claim 1, to receive a plurality of cable and portions (3);

wherein said seating and retaining part elements (11, 12) are formed with parallel recesses (17, 18) for receiving the respective cable end portions, said recesses extending from said engagement surfaces (15, 16) to receive the respective cable and portions upon placement of the two elements (11, 12) against each other, with said matching engagement surfaces in contact and engagement.

7. The structure of claim 6, wherein said seating and retaining part elements comprise parallel half part-cylindrical portions, and a connecting web (19, 20) joining adjacent parallel half part-cylindrical portions to form, when said two seating and retaining part elements are assembled, in end view, a generally "figure 8" configuration defined by part-cylindrical portions and the connecting web (19, 20);

and wherein said interengaging projection-and-recess means comprise projection elements located on the web (19, 20) of each of said elements, and engageable behind a recess formed in the housing opposite each said projection.

8. Sealed protected multi-cable lead-in and plug connector structure having a housing (1, 10) of insulating material formed with a plurality of bores (2), each receiving a cable (3), each cable having an end portion including an insulating sheath (**3*a*) and a conductor core (3*b***);

individual electrical terminal (4, 7) secured to the respective cores (**3*b*) of the cables (3) and attached to the respective insulating sheaths (3*a***) of the cables;

individual cable seals (5, 8) sealing the outside of the insulating sheaths of the respective cables (3) against the insides of the respective bores (2) of the housing;

an enlarged cable receiving end recess (9) adjacent an end portion of said housing, said bores (2) terminating in said recess and the cable seals (5, 8) being seated in said respective bores inwardly of said cable receiving recess and between said recess and the respective terminals;

and an end seating and retaining part of insulating material fitted into the end recess (9) of the housing and closing the cable element receiving bores (2) and said end recess of the housing towards the outside, while locating and retaining said seals (5, 8) in said respective bores (2), wherein the end seating and retaining part comprises two half elements (11, 12) having essentially half part-cylindrical portions, and having matching engagement surfaces (15, 16), said engagement surfaces (15, 16) being defined by parallel matching axially extending surface portions, and with essentially semi-cylindrical recesses (17, 18) formed in said surfaces receiving the respective cables (3), said recesses extending from said axially extending surface portions (15, 16) to receive the cables therein upon placement of the two elements against each other, with said axially extending matching surface portions (15, 16) in contact and engagement;

and wherein said half-elements (11, 12) and an end portion (10) of the housing are formed with releasable interengaging projection-and-recess means (21, 23, 22, 24) for retaining said two half-elements (11, 12) of the seating and retaining part in position in the housing and to close off said bores (2) to protect the seals therein, and for positively positioning the portion of the respective cables between the end of the housing and said respective seals (5, 8) within the respective bores (2) and thereby protect the seals against loosening and damage transferred thereto by mishandling of the cables.

9. The structure of claim 8, wherein the element halves are formed with depressed or constricted portions (19, 20) at the outer circumference thereof in alignment with a central plans passing between the essentially semi-circular recesses receiving the cable elements.

10. The structure of claim 8, wherein the projection-and-recess means comprises recesses (23, 24) formed in the housing, each defining an abutment shoulder, and a snap-in projection (11, 22) formed on each of the element halves (11, 12) positioned and dimensioned to snap behind said abutment shoulder.

11. The structure of claim 9, wherein the element halves are formed with depressed or constricted portions (19, 20) at the outer circumference thereof in alignment with a central plane passing between the essentially semi-circular recesses receiving the cable elements.

and wherein said snap-in projections are located in the region of said depressed or constricted portions (19, 20).

12. The structure of claim 8, wherein said seating and retaining part half elements comprise parallel half part-cylindrical portions and a connecting web joining adjacent parallel half part-cylindrical portions to form, when said two seating and retaining part half elements are assembled, in and view, a generally "figure 8" configuration;

and wherein said interangaging projection-and-recess means comprise projection elements located on the web of each of said elements, and engageable behind a recess formed in the housing opposite each said projection.

13. The structure of claim 8, wherein said seating and retaining part half elements comprise parallel half part-cylindrical portions and a connecting web joining adjacent parallel half part-cylindrical portions to form, when said two sealing and retaining part elements are assembled, in and view, a generally undulating configuration;

and wherein said interengaging projection-and-recess means comprise projection elements located on at least one web of each of said elements, and engageable behind a recess formed in the housing opposite each said projection.

14. The structure of claim 8, wherein the matching engagement surfaces (15, 16) of said two seating and retaining part half elements (11, 12) define a separating plane, said separating plane being located in a plane at least approximately parallel to a connecting plane extending centrally through the respective cables.

15. The structure of claim 11, wherein the matching engagement surfaces (15, 16) of said two seating and retaining part half elements (11, 12) define a separating plane, said separating plane being located in a plane at least approximately parallel to a connecting plane extending centrally through the respective cables.

16. The structure of claim 12, wherein the matching engagement surfaces (15, 16) of said two seating and retaining part half elements (11, 12) define a separating plane, said separating plane being located in a plane at least approximately parallel to a connecting plane extending centrally through the respective cables.

17. The structure of claim 13, wherein the matching engagement surfaces (15, 16) of said two seating and retaining part half elements (11, 12) define a separating plane, said separating plane being located in a plane at least approximately parallel to a connecting plane extending centrally through the respective cables.

18. An electrical connector structure for a cable (3) having a conductor core (3*b*), an insulating sheath (3*a*) surrounding the conductor core (3*b*) and an electrical terminal (4, 7) crimped over the respective sheath and the conductor core, said connector having a housing (1, 10) with at least one bore (2), each bore (2) receiving an end portion of an of an associated cable (3) and an electrical terminal (4, 7) crimped together with an insulating sheath (3*a*) and with a conductor core (3*b*) of said cable;

a seal (5) surrounding the cable (3) and sealing the outside of the insulating sheath (3*a*) against the inside of said bore receiving the associated cable of said housing;

a recess (9) larger than said bore formed in an end portion (10) of said housing, said bore (2) terminating in said recess;

and an end seating and retaining part surrounding said cable (3) and passing the cable outside the housing through said end seating and retaining part, said end seating and retaining part being fitted into the recess (9) of said housing and detachably fitted thereto, closing said recess towards the outside, while retaining said seal in sealing position in the housing and surrounding said cable passed outside the housing through said end seating and retaining part, wherein, each cable (3) with the associated seal (5, 6, 8) and with the associated electrical terminal (4, 7) subassembed them to, is individually arranged and sealed in said associated bore (2) of the housing (1), the end seating and retaining part comprises two half elements (11, 12) having matching engagement surfaces (15, 16)

said matching engagement surfaces being in contact with each other when the half elements are fitted into said recess (9) for retaining the seal or seals (5, 6, 8) of the at least one cable in the associated bore or bores (2), and wherein said half elements and the end portion (10) of the housing (1) are formed with snap-in means (21, 23; 22, 24) for detachably snapping-in of the half elements (11, 12) inside the housing (1, 9, 10).

19. The structure of claim 18, wherein the engagement surface (15, 16) of each half element (11, 12) is formed with at least one essentially semi-circular recess (17, 18), each pair of recesses (17, 18) surrounding the associated cable (3) passed outside the housing (1, 9, 10) through the end seating and retaining part.

20. The structure of claim 18 to receive a plurality of cables (3), wherein said housing is formed with a plurality of bores (2);

wherein the recess (9) is dimensioned to extend across the ends or openings of said bores (3) and said bores terminate in said recess (9) and wherein said seating and retaining part half-elements are formed with parallel recesses (17, 18) of essentially semi-cylindrical form for receiving the respective portions of the cables (3) and defining a plurality of pairs of recesses, receiving the respective cable portions upon placement of the two element halves against each other with said matching engagement surfaces in contact and engagement, and fitting of said element halves into said recess (9) formed in the end portion of the housing.

21. The structure of claim 20, wherein said seating and retaining part elements comprise parallel half part-cylindrical portions, and a connecting web (19, 20) joining adjacent parallel half part-cylindrical portions to form, when said two seating and retaining part elements are assembled, in end view, a generally "figure 8" configuration defined by part-cylindrical portions and the connecting web (19, 20);

and wherein said interengaging projection-and-recess means comprise projection elements located on the web (19, 20) of each of said elements, and engageable behind a recess formed in the housing opposite each said projection.

* * * * *